US006640672B1

(12) United States Patent
Cheng

(10) Patent No.: US 6,640,672 B1
(45) Date of Patent: Nov. 4, 2003

(54) SCREWDRIVER

(75) Inventor: Mei-Hua Cheng, Tu Cheng (TW)

(73) Assignee: Gong Fong Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 10/222,584

(22) Filed: Aug. 19, 2002

(51) Int. Cl.[7] ..... B25B 23/16

(52) U.S. Cl. ..... 81/177.5; 81/177.2; 81/177.6; 81/177.7

(58) Field of Search ..... 81/177.8, 177.2, 81/177.5, 177.6, 177.7, 436–440

(56) References Cited

U.S. PATENT DOCUMENTS 2,572,444 A * 10/1951 Carden ..... 81/177.8
4,334,445 A * 6/1982 Timewell ..... 81/177.7
5,722,307 A * 3/1998 Chen ..... 81/58.3
5,816,119 A * 10/1998 Herue ..... 81/60
5,943,921 A * 8/1999 Lin ..... 81/59.1
6,095,018 A * 8/2000 Schuster ..... 81/177.5
6,116,123 A * 9/2000 Chen ..... 81/177.2
6,145,413 A * 11/2000 Lin ..... 81/63.1

* cited by examiner

*Primary Examiner*—Joseph J. Hail, III
*Assistant Examiner*—David B. Thomas
(74) *Attorney, Agent, or Firm*—Rosenberg, Klein & Lee

(57) ABSTRACT

A screwdriver includes a handle, a ratchet socket, a rotary linkage and a cap. The handle has a channel inside to accommodate the rotary linkage with one end inserted with the ratchet socket and a screwdriver socket. The rotary linkage includes a linkage, a tube, a stop section, a spring and a pivoting rod. The linkage has one end pivoted to the stop section inserted in the spring and penetrates axially in the tube. One end of the tube protrudes a wall at the inner periphery and has a pair of gaps at the end. Another end of the linkage is pivoted to the pivoting rod and the cap. The cap is pulled to draw out the linkage with the stop section at the end of the linkage to compress the spring to hold against the wall of the tube, and the pivoting rod is bent for rotation.

3 Claims, 3 Drawing Sheets

SCREWDRIVER

BACKGROUND OF THE INVENTION (a) Field of the Invention

The present invention relates to a structure of a screwdriver, and more particularly, to one that when expanded, the screwdriver may be driven laterally by means of a linkage and said linkage can be retreated into the handle to become a normal screwdriver.

(b) Description of the Prior Art

A conventional screwdriver generally available in the market is essentially composed of a shank with a flat or a cross-headed tip axially extending from the lower end of a handle. In addition, there is a spiral screwdriver with a ratchet provided to its shank to allow one-way rotation essentially by taking advantage of the one-way rotation features provided by the ratchet to drive clockwise or counterclockwise to tighten or loosen a bolt. However, both of the conventional screwdriver and the spiral screwdriver are found with defectives mainly attributable to the following reasons:

(1) The force is essentially applied from the handle and it becomes difficult to drive particularly in a narrow working space in the absence of a proper location to apply the force.

(2) The application of the force is always fixed to one direction and the location of applying the force falls directly on the handle, meaning, smaller turning torque and greater efforts.

SUMMARY OF THE INVENTION

The primary purpose of the present invention is to provide a screwdriver composed of a handle, a ratchet socket, a rotary linkage and a cap. Wherein, a channel is provided in the handle to accommodate the linkage while the lower end of the handle is inserted with the ratchet socket and the screwdriver socket. The rotary linkage comprises a linkage, a tube, a stop section, a spring and a pivoting rod. One end of the linkage is pivoted to the stop section inserted in the spring and penetrates through the tube, and the tube has a wall protruding from the inner periphery of the tube, and a pair of gaps are provided at the end of the tube. Another end of the linkage is movably pivoted to the cap. When in use, the cap is pulled out to forthwith draw out the linkage with the stop section at the end of the linkage to compress the spring and hold against the wall of the tube, thus relatively to be bent in relation to the stop section and hold against the gaps in the tube, finally the pivoted linkage is bent to be gripped by the user to drive.

DETAILED DESCRIPTION OF THE PREFERRED EMBODIMENTS

Figure 1:
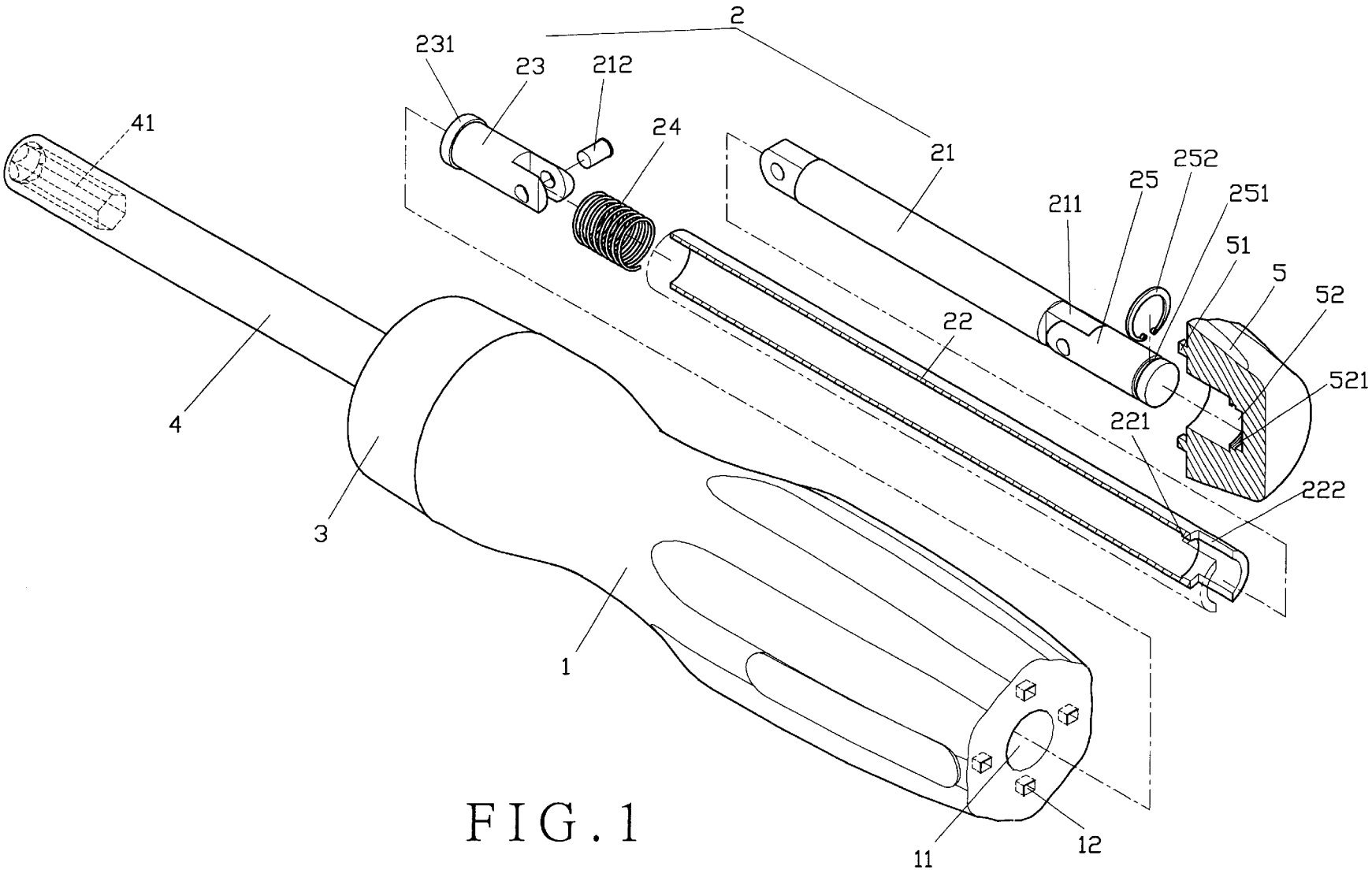
FIG. 1 is an exploded view of a preferred embodiment of the present invention.

Referring to FIG. 1, a preferred embodiment of the present invention is essentially composed of a handle (1), a rotary linkage (2), a ratchet socket (3), a screwdriver socket (4) and a cap (5).

A channel (11) is provided inside the handle (1) to accommodate the rotary linkage (2). One end of the handle (1) is axially inserted with the ratchet socket (3) that rotates in one-way direction, and a screwdriver socket (4) is fixed inside the ratchet socket (3) with the end of the screwdriver socket (4) disposed with a hexagonal hole (41) to merely allow axial insertion of a tip. A plurality of positioning slots (12) is provided on the end surface of the handle (1).

The rotary linkage (2) includes a linkage (21), a tube (22), a stop section (23), a spring (24), and a pivoting rod (25). Both ends of the linkage (21) are formed each a pivoting end (211) and one end of the linkage (21) is pivoted to the stop section (23) inserted in the spring (24) by means of a pivoting pin (212). One end of the stop section (23) protrudes to form a wall (231) and axially penetrates through the hollow tube (22), which is tightly inserted into the channel (11) in the handle (1) while one end of the tube (22) has another wall (221) protruding from the inner periphery of the tube (22) and a pair of gaps (222) are provided at the end of the tube (22). Another end of the linkage (21) is pivoted to the pivoting rod (25) and the end of the pivoting rod (25) is provided in recess a locking slot (251) with a locking ring (252).

The cap (5) has provided with a plurality of positioning walls (51) in relation to the positioning slots (12) of the handle (1), and an insertion hole (52) with a locking slot (521) is disposed at the center of the cap (5) to be pivoted to the pivoting rod (25) by means of the locking ring (252) for both of the linkage (2) and the cap (5) to be pivoted to each other and rotate relatively to each other.

Figures 2, 2A:
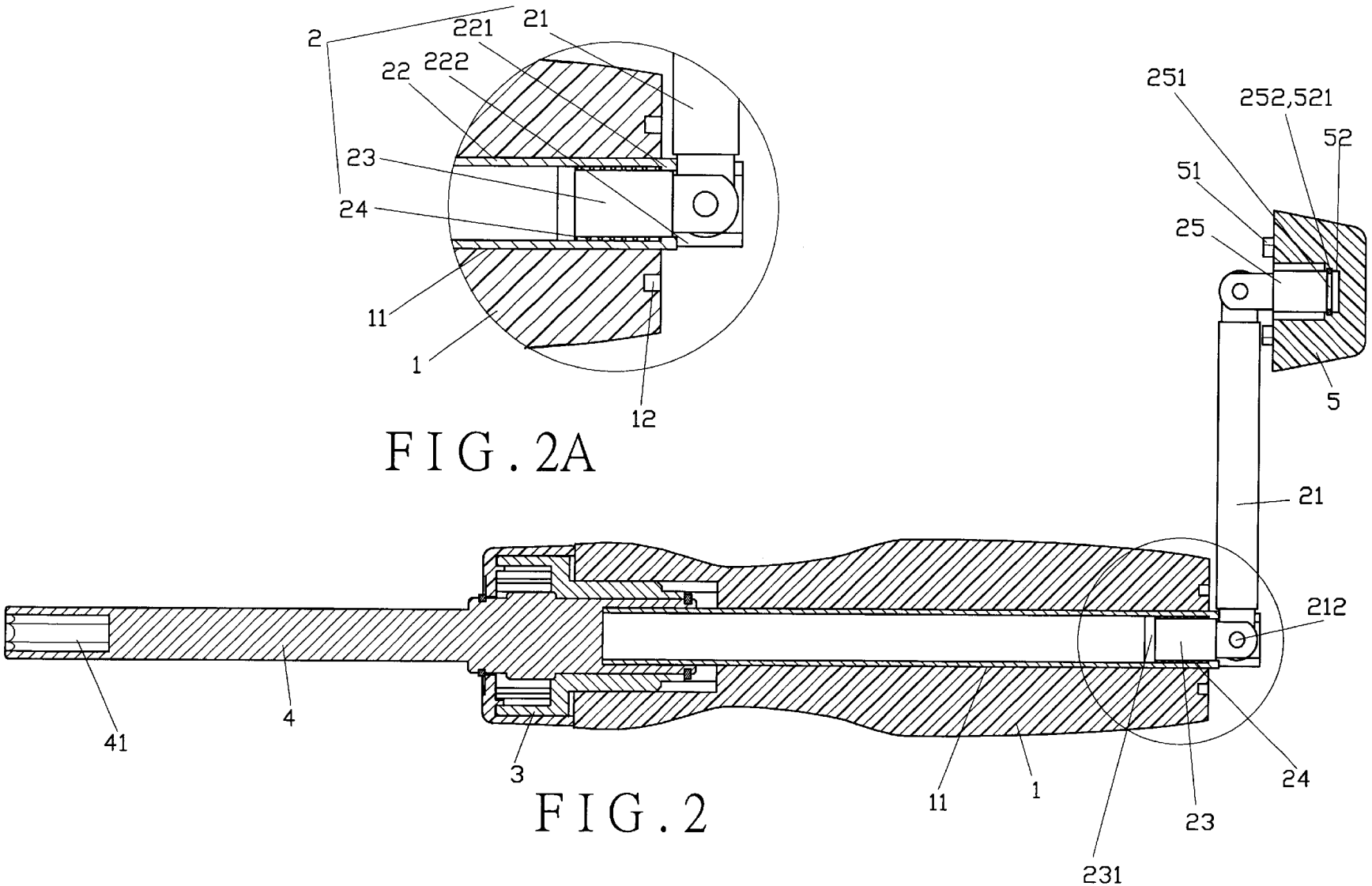
FIG. 2 is a cross-sectional view showing an assembly of the preferred embodiment of the present invention in use.
FIG. 2A is an enlarged view taken from FIG. 2.

With the preferred embodiment of the present invention assembled as illustrated in FIG. 2, one end of the linkage (21) is pivoted to the stop section (23) inserted into the spring (24), and the linkage (21) penetrates axially through the tube (22) and the exposed pivoting rod (25) is connected to the cap (5). Meanwhile, the tube (22) penetrates through and is tightly inserted in the channel (11) in the handle (1) thus to be integrated mutually with the screwdriver socket (4). While in use, the cap (5) is pulled to forthwith draw out the linkage (21) to such extent that the stop section (23) at the end of the linkage (21) slides axially inside the tube (22) for the stop section (23) to compress the spring (24) and hold against the wall (221) protruding from the inner periphery of the tube (22). The linkage (21) is then bent to become vertical to the stop section (23) and is held in position in the gaps (222) by taking advantage of return force of the spring (24). The pivoting rod (25) is further bent to become vertical to the linkage (21). Upon rotating the cap (5), the linkage (21) is driven by the pivoting rod (25) to activate the tube (22) and then the handle (1) for the screwdriver socket (4) to rotate accordingly. Whereas an arm is formed by the linkage (21) and the tube (22), the turning of the handle (1) of the screwdriver of the present invention is significantly easier and faster than that of the prior art.

Figure 3:
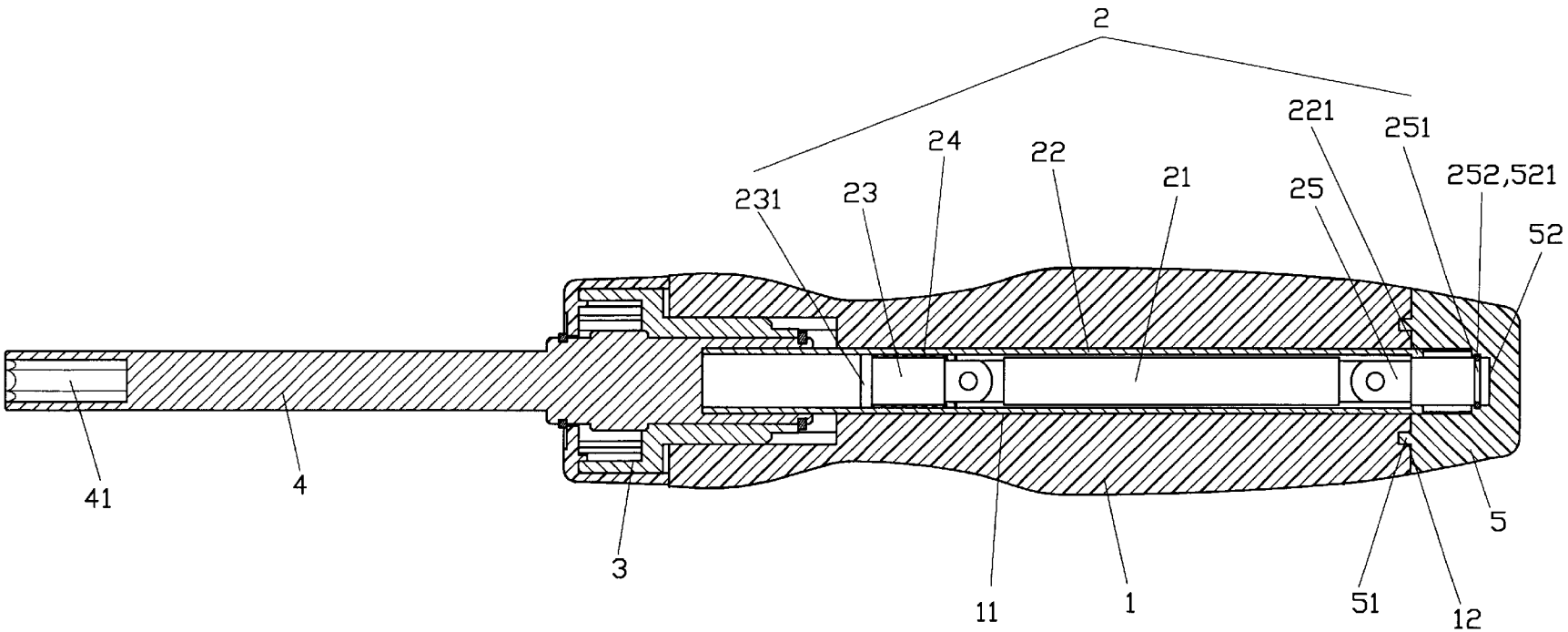
FIG. 3 is a cross-sectional view showing the assembly of the preferred embodiment of the present invention in storage.

If the rotary linkage (2) is not used as illustrated in FIG. 3, both of the pivoting rod (25) and the linkage (21) are bent to become on the same straight line with the tube (22) and then pushed back inwardly in relation to the tube (22) so that the positioning walls (51) on the cap (5) merely engage in position with the positioning slots (12) on the handle (1) with all the linkage (21), the stop section (23), the spring (24) and the pivoting rod (25) to be concealed inside the tube (22) to become a conventional screwdriver.

As disclosed, the present invention features an innovative, compact and practical structure with the rotary linkage to be drawn out and bent to permit an arm to facilitate applying the force at where greater efforts are required to use the screwdriver.

I claim:

1. A screwdriver essentially comprising a handle, a rotary linkage, a ratchet socket, a screwdriver socket and a cap;

said handle having a channel inside to accommodate said rotary linkage, one end of said handle being inserted with said ratchet socket, and said screwdriver socket being fixed inside said ratchet socket to receive insertion of a tip; and said rotary linkage including a linkage, a tube, a stop section, a spring and a pivoting rod, said linkage having one end pivoted to said stop section inserted in said spring, and penetrating axially through said tube, said tube being inserted in said channel of said handle, a wall extending from said inner periphery at one end of said tube, a pair of gaps being provided at the end of said tube, and the other end of said linkage being pivoted to said pivoting rod, and further to said cap;

said linkage being forthwith drawn out by pulling up said cap for said stop section of said linkage to compress said spring and hold against said wall of said tube, then being bent and holding against in said gaps of said tube in relation to said stop section, and said pivoting rod being bent to form a handle for rotation.

2. A screwdriver as claimed in claim 1, wherein, said handle provides a plurality of positioning slots at the end surface and said cap provides a plurality of positioning walls to engage in position with said positioning slots of said handle.

3. A screwdriver as claimed in claim 1, wherein, an insertion hole with a locking slot is provided at the center of said cap, said cap is connected to said pivoting rod by means of a locking ring, and said cap and said pivoting rod are pivoted to each other for rotation.

* * * * *